United States Patent [19]

Zakarian

[11] 4,183,115

[45] Jan. 15, 1980

[54] BLOW-OFF DUCTING AND BAFFLING FOR CAN WASHER

[75] Inventor: Armen Zakarian, Arlington Heights, Ill.

[73] Assignee: The Continental Group, Inc., New York, N.Y.

[21] Appl. No.: 943,413

[22] Filed: Sep. 18, 1978

[51] Int. Cl.[2] ..... B08B 3/40; B08B 5/02

[52] U.S. Cl. ..... 15/302; 15/306 B; 15/316 R; 134/60; 134/72

[58] Field of Search ..... 15/302, 306 B, 316 R, 15/306 R, 306 A; 134/61, 72, 60

[56] References Cited

U.S. PATENT DOCUMENTS

| | | | |
|---|---|---|---|
| 2,644,188 | 7/1953 | Pacilio | 15/306 B X |
| 2,926,674 | 3/1960 | Umbricht et al. | 134/72 |
| 3,660,910 | 5/1972 | Evans et al. | 134/72 X |
| 3,805,316 | 4/1974 | Sheppard | 15/306 B |
| 4,073,029 | 2/1978 | Vassallo | 15/302 |

*Primary Examiner*—Christopher K. Moore
*Attorney, Agent, or Firm*—Charles E. Brown

[57] ABSTRACT

A can washer for washing newly formed cans. The washing components are mounted within a housing, and following each wash or rinse stage there is a blow-off stage wherein air is directed against the wet can to dry the same. Air for the blow-off stages is withdrawn from within the interior of the can washer and in order to prevent the drawing in of air from the wash stage special baffling and ducting is provided so that in each instance air is drawn in for the blow-off stage from the clean water area of an adjacent rinse stage.

4 Claims, 1 Drawing Figure

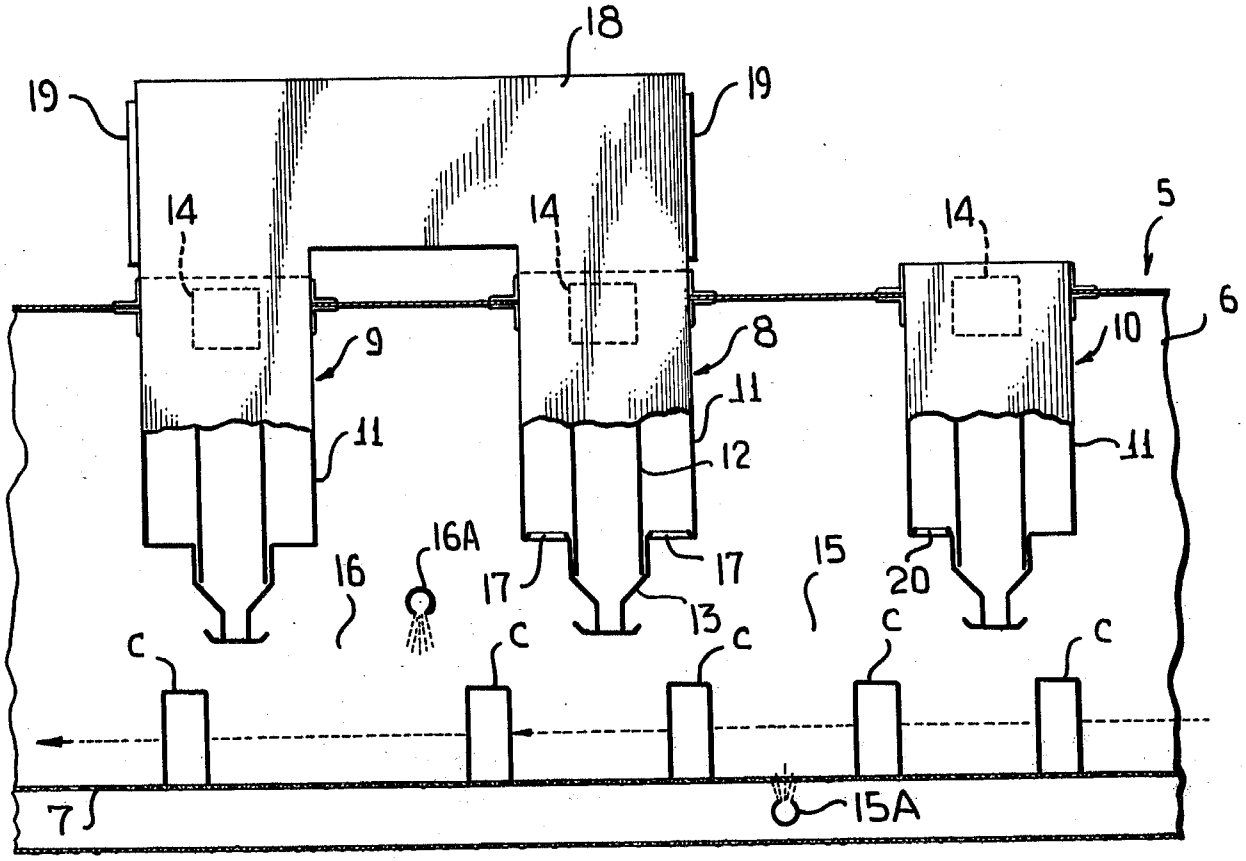
5
6
10
11
14
20
C
15
15A
19
8
12
17
13
18
16A
9
16
7

BLOW-OFF DUCTING AND BAFFLING FOR CAN WASHER

This invention relates in general to new and useful improvements in can washing equipment, and more particularly to can washing equipment wherein there is a blow-off stage following a wash stage and a rinse stage.

There has been developed suitable can washers for washing cans after the formation thereof. Such a typical can washer is disclosed in the U.S. patent to Beyer, et al, U.S. Pat. No. 3,952,698, granted Apr. 27, 1976.

In can washers of the type to which this invention relates, there is an elongated housing through which cans to be washed or otherwise treated pass. In this housing are various wash, rinse and blow-off stages. Outside air cannot be beneficially introduced in the blow-off stages in that this would result in undesired pressurization of the housing with the result that air would be caused to flow from one stage to another. Inasmuch as various coating and washing compounds are involved in such a can washer, the circulation of the various compounds from the different stages would result in undesirable reactions.

In accordance with this invention, it is proposed to modify existing can washers wherein air for each blow-off stage is directly received from within the housing at that particular stage. Most particularly, when there is a wash stage followed by a rinse stage and there is a separate blow-off stage associated with both the wash stage and the rinse stage, the customary intake of the blow-off stage associated with the wash stage is closed and suitable ducting is provided from the blow-off stage associated with the rinse stage, with the ducting leading to the blow-off stage associated with the wash stage for directing uncontaminated air thereto.

It is also proposed to provide a blow-off stage which precedes the wash stage with suitable baffling which will greatly reduce, if not preclude, the drawing in of air contaminated by the wash stage.

With the above and other objects in view that will hereinafter appear, the nature of the invention will be more clearly understood by reference to the following detailed description, the appended claims and the view illustrated in the accompanying drawing.

IN THE DRAWING

The drawing is a longitudinal sectional view through a portion of a conventional can washer modified in accordance with this invention.

Referring now to the drawing in detail, there is illustrated a portion only of a can washer generally identified by the numeral 5. The can washer 5 may have numerous stations or stages therein, including stages wherein suitable coating materials are applied to the interior of the can body. The can washer 5 is particularly adapted to be utilized in conjunction with two-piece cans, i.e. cans wherein the body and bottom end are integrally formed. This invention relates solely to a wash and rinse area of the can washer.

The can washer 5 includes an elongated housing 6. Extending through the bottom of the housing 6 is an upper run of an endless conveyor 7 which may be in the form of a suitable screen. Cans C are delivered to the conveyor 7 and move therethrough from right to left, as viewed in the drawing. Although only scattered cans have been illustrated, it is to be understood that for purposes of economy the conveyor 7 should be substantially fully loaded.

The housing 6 has mounted on the upper part thereof a plurality of blow-off units or stages. These include a first blow-off stage 8, a second blow-off stage 9, and a third blow-off stage 10. Each blow-off stage includes a housing 11 which extends transversely of the housing 6 for substantially the full width thereof. A delivery tube 12 extends down out of the housing 11 and has mounted thereon a nozzle 13 which is vertically adjustable. Normally the housing 11 surrounding the delivery tube 12 forms an intake through which air is drawn upwardly by means of a suitable blower 14 for direction into the delivery tube 12 and out of the nozzle 13. This is a conventional blow-off stage construction.

It will be readily apparent that since the lower end of the housing 11 forms the intake for air to be utilized in the blow-off operation, the air will be of a quality determined by the surrounding atmosphere.

In a typical can washer, there is a wash stage 15 between the blow-off stages 10 and 8, which includes a sprayer 15A normally positioned for spraying the interior of cans through the conveyor 7, as shown. Also, there will be a rinse stage 16 between the blow-off stages 8 and 9 which includes a sprayer 16A positioned above the conveyor for rinsing the exteriors of cans to remove any washcoat resin which may be applied to the exterior of the cans. There will be other wash and rinse stages in advance of the blow-off stage 10, with there normally being a rinse stage (not shown) immediately preceding the blow-off stage 10.

It will be readily apparent from the drawing that when air is drawn into the bottom of the housing 11 of the blow-off stage 8, at least a considerable portion of the air will be from the general area of the wash stage 15. It is to be understood that the wash stage 15 utilizes a washcoat resin which is infused in a washcoat mist in the area of the wash stage, and that normally this resin is drawn into the housing 11 of the blow-off stage 8, resulting in a build-up of washcoat resins on the blower 14 and housing 11.

Consideration was given to supplying air from exteriorly of the housing 6 to the blow-off stage 8. However, this would result in introduction of outside air into the housing 6 and the formation of air currents blowing longitudinally through the housing 6. This would result in moist contaminated acidic air from upstream of the housing 6 being unduly circulated within the housing and thus contaminating other areas and in certain instances causing reactions with the washcoat.

In accordance with this invention, the existing problem has been solved by placing in the lower end of the housing 11 on opposite sides of the delivery tube 12 baffles 17. These baffles, together with the delivery tube 12, extend the full transverse direction of the housing 11 and thus block the normal intake for the blower 14.

The housing 11 of the blow-off stage 9 is positioned downstream of the rinse stage 16 and thus has access to relatively clean and uncontaminated air. No difficulties exist at the rinse stage 9. Therefore, in accordance with this invention, a generally inverted U-shaped duct 18 is provided and is so mounted with respect to the housing 11 of the blow-off stages 8 and 9 that a portion of the air drawn into the housing 11 of the blow-off stage 9 is directed externally of the housing 6 within the duct 18 to the upper end of the housing 11 of the blow-off stage 8. It will be readily apparent that the mounting of the duct 18 is a simple one, all that is necessary being that the upper end of the housing 11 be moved and the duct 18 bolted in place utilizing conventional mounting flanges.

In order that access to the blower 18 of the blow-off stages 8, 9 may be obtained, the opposite ends of the duct 18 are provided with access doors or panels 19.

It has also been found desirable to modify the blow-off stage 10. As described above, the blow-off stage 10 is located upstream of the wash stage 15, and thus normally between the wash stage 15 and a further upstream rinse stage (not shown). It has been found that the blow-off stage 10 may be beneficially modified by positioning in the lower end of the housing 11 thereon on that part of the housing 11 adjacent the wash stage 15 a further baffle 20 which would be identical to one of the baffles 17. Thus, the supplying to the blower 14 of the blow-off stage 10 would be from the upstream side only of the housing 11.

Although the changes made in existing can washing equipment have been relatively minor and can be conducted at a relatively low cost, the results have proved to be very beneficial and previously experienced problems, particularly with respect to the blow-off stages 8 and 9, have been eliminated.

Although only a preferred embodiment of the can washer modification has been specifically illustrated and described herein, it is to be understood that minor variations may be made in the can washing modification without departing from the spirit and scope of the invention as defined by the appended claims.

I claim:

1. A container washer of the type including an elongated housing, a conveyor for moving containers through said housing, a wash station for applying a wash liquid to containers moving through said housing, a rinse station spaced downstream from said wash station for applying clean rinse water to washed containers, a first blow-off station intermediate said wash station and said rinse station, a second blow-off station adjacent to and spaced downstream of said rinse station, each of said blow-off stations being of the type including a downwardly opening nozzle projecting from a surrounding duct normally defining an air intake supplying air for the respective nozzle, and means for directing air from each said air intake under pressure to the respective nozzle; the improvement comprising means closing said first blow-off station duct against entrance of air from below to thereby exclude wash components, and a duct section coupling said second blow-off station duct to said first blow-off station duct to supply air drawn from the vicinity of said rinse station to said first blow-off station.

2. The container washer of claim 1 wherein said duct section is generally of an inverted U-shape.

3. The container washer of claim 1 wherein said duct section is generally of an inverted U-shape, and having a cross section generally corresponding to the cross section of said second blow-off station duct.

4. The container washer of claim 1 wherein there is a third blow-off station upstream of said wash station said third blow-off station also including a downwardly opening nozzle, an intake duct generally surrounding said third blow-off station nozzle for supplying air thereto, and means for directing air from said third blow-off station intake duct to the respective nozzle under pressure, the improvement further comprising means closing off said third blow-off station intake duct on that side of the respective nozzle adjacent said wash station.

* * * * *